United States Patent [19]

Falconieri et al.

[11] Patent Number: 4,900,169

[45] Date of Patent: Feb. 13, 1990

[54] PRINT HAMMER DAMPING MECHANISM FOR TYPEWRITERS AND LIKE PRINTING MACHINES

[75] Inventors: Remo Falconieri, S. Giorgio C.SE; Ester G. Gianotti, Albiano, both of Italy

[73] Assignee: Ing. C. Olivetti & C., S.p.A., Ivrea, Italy

[21] Appl. No.: 208,788

[22] Filed: Jun. 17, 1988

Related U.S. Application Data

[63] Continuation of Ser. No. 871,384, Jun. 6, 1986, abandoned.

[30] Foreign Application Priority Data

Jun. 28, 1985 [IT] Italy ..... 67590 A/85

[51] Int. Cl.[4] ..... B41J 9/38

[52] U.S. Cl. ..... 400/157.2; 400/167; 400/686; 101/93.02

[58] Field of Search ..... 400/144.2, 157.1, 157.2, 400/167, 686; 188/378, 379, 385; 101/93.02, 93.29, 93.48; 335/255, 257

[56] References Cited

U.S. PATENT DOCUMENTS

| | | | |
|---|---|---|---|
| 3,134,932 | 5/1964 | Ray | 335/257 |
| 3,400,351 | 9/1968 | Flentge | 335/257 |
| 4,308,794 | 1/1982 | Adamoli et al. | 400/157.2 |
| 4,422,784 | 12/1983 | Arzoumanian et al. | 400/157.2 |
| 4,430,936 | 2/1984 | Adamoli et al. | 400/157.2 |
| 4,490,057 | 12/1984 | Reece | 335/257 |
| 4,496,253 | 1/1985 | Morsing | 400/167 |
| 4,613,243 | 9/1986 | Rossi et al. | 400/167 |

FOREIGN PATENT DOCUMENTS

| | | | |
|---|---|---|---|
| 142316 | 3/1979 | German Democratic Rep. | 400/157.2 |
| 218044 | 1/1985 | German Democratic Rep. | 101/93.02 |
| 231203 | 12/1985 | German Democratic Rep. | 400/167 |
| 75888 | 6/1981 | Japan | 400/157.2 |
| 49395 | 10/1982 | Japan | 400/157.2 |
| 110274 | 6/1983 | Japan | 400/157.2 |
| 15184 | 1/1985 | Japan | 400/157.2 |
| 68980 | 4/1985 | Japan | 400/157.2 |
| 120076 | 6/1985 | Japan | 400/167 |

OTHER PUBLICATIONS

S. Mitrovich, "Multi-Impact Backstop for Print Hammer", *Xerox Disclosure Journal*, vol. 1, No. 4, p. 21; Apr. 1976.

*Primary Examiner*—David A. Wiecking

*Attorney, Agent, or Firm*—Banner, Birch, McKie & Beckett

[57] ABSTRACT

The print apparatus comprises a character-carrying element of the 'daisywheel' type with flexible spokes which can be selectively positioned in front of a platen roller, a print hammer for moving a selected character towards the platen roller, an actuating solenoid for the print hammer and a damping mechanism which acts on the hammer after the printing of each character. The hammer is directly connected to a movable armature of the solenoid and is returned by a return spring.

During the return phase, the armature displaces, against a travel limiting stop, a counteracting weight which is urged towards an intermediate stop by the force of a counteracting spring. A first damping element is disposed between the movable armature and the counteracting weight and a second damping element is disposed between the weight and the travel limiting stop. The two damping elements, operating sequentially, minimize the time required for the hammer to settle down.

15 Claims, 4 Drawing Sheets

PRINT HAMMER DAMPING MECHANISM FOR TYPEWRITERS AND LIKE PRINTING MACHINES

This application is a continuation, of application Ser. No. 871,384, filed June 6, 1986, now abandoned.

BACKGROUND OF THE INVENTION

The present invention relates to a print device for a typewriter or like printing machine. The device is of the kind comprising a character-carrying element having flexible spokes which can be selectively positioned in front of a platen roller, a print hammer for moving the selected character towards the platen roller, and an activating solenoid for the print hammer. In a first aspect, the invention concerns in particular a device having a damping mechanism for reducing the time for the hammer to settle down after the printing of each character.

In such devices, the print hammer covers a relatively long distance in going from a rest position in which it is spaced from the character-carrying spokes to the print position in which the selected spoke is first flexed and then caused to strike against the platen roller. In view of the substantial amounts of energy involved, damping of the vibrations of the hammer is essential in order to achieve a high print rate.

In a known device, damping of the hammer is effected by a rubber block carried by a counteracting lever which in turn is pivoted on a fixed pin and is held in contact against a stop by a suitable counteracting spring. A coil spring which is wound around the pin acts as a friction element between the layer and the pin. That damping mechanism is fairly expensive while in addition the time required for the hammer to settle down is fairly high and is not suitable for high-performance printers.

SUMMARY OF THE INVENTION

One object of the present invention is therefore to provide a print device which is simple, compact and economical and which also permits a substantial reduction in the time for settlement of the hammer after printing of the selected character.

To this end, the print device according to the present invention is characterised in that the damping mechanism comprises a series of mutually independent and movable damping elements which perform sequential damping functions, minimising the time for the print hammer to settle down.

Other aspects of the invention are defined in the appended claims.

BRIEF DESCRIPTION OF THE DRAWING

The invention will be described in more detail, by way of example, with reference to the accompanying drawing, in which:

Referring to FIG. 1, the print device 10 embodying the invention is fitted to a typewriter comprising a platen roller 11 having a point of typing 12 and a carriage 13 which is movable on a cylindrical guide 14 parallel to the roller 11. The carriage 13 comprises two side members 16 and 17 which are orthogonal to the axis of the guide 14. The carriage 13 is displaced by a motor (not shown in the drawing) by way of a belt 18 which is connected to the side members 16 and 17.

Figure 1:
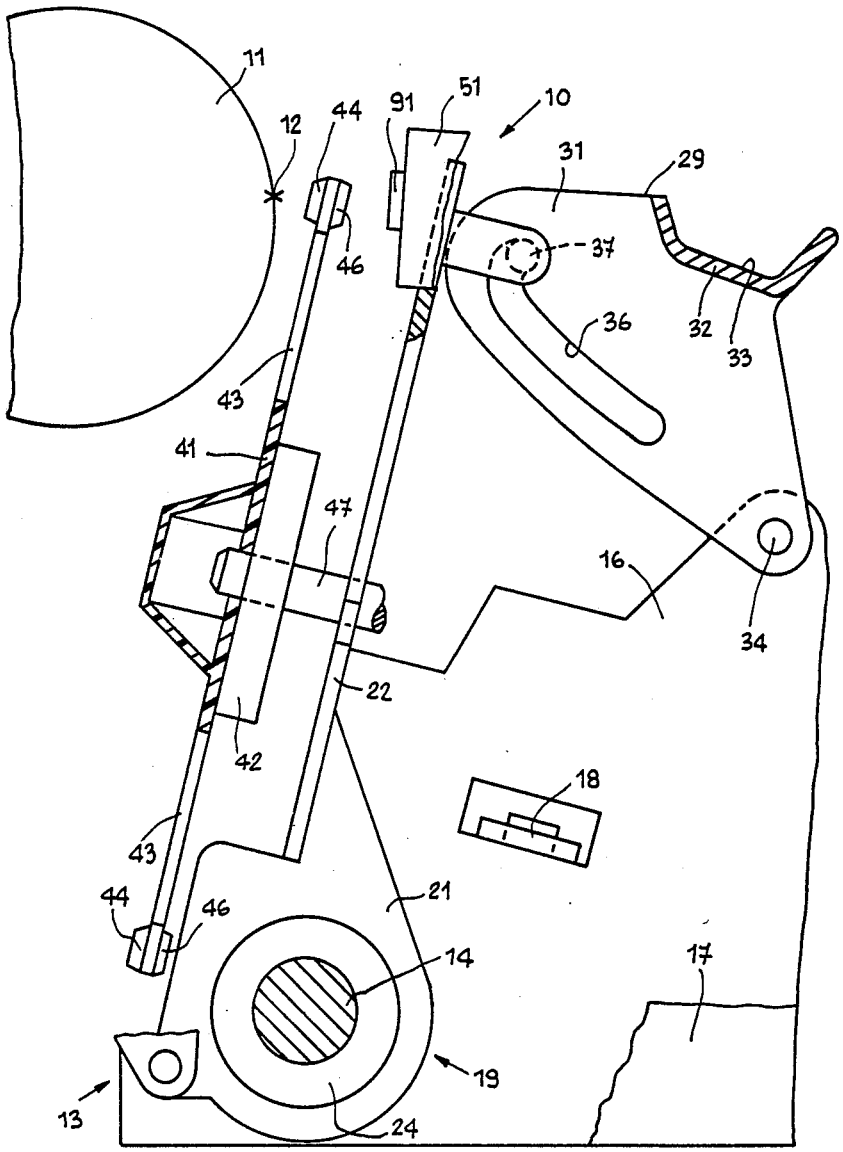
FIG. 1 is a longitudinal view of part of a typewriter on which a print device embodying the invention is mounted.

A frame structure 19 which is disposed between the side members 16 and 17 of the carriage 13 is of such a configuration as to provide two side members 21 and a plate 22 which is parallel to the platen roller 11 and on which the print device 10 is mounted. The side members 21 of the frame structure 19 are fixed to two bushes 24 on the carriage 13, which are coaxial with respect to the cylindrical guide 14. In that way the frame structure 19 is pivotable with respect to the cylindrical guide 14 and can follow the movement of the carriage 13.

A bridge lever or bail 29 which can be actuated manually is provided for tilting the frame structure 19 with respect to the side members 16 and 17 and comprises two arms 31 (only one thereof is visible in the drawing) which are parallel to the side members 16 and 17, and a transverse member 32. The two arms 31 are each pivoted on a pin 34 which is fixed to the side members 16 or 17 of the carriage 13 and each arm 31 is provided with a slot 36 with which a peg 37 on the frame structure 19 co-operates in such away that a clockwise rotary movement of the lever 29 produces a clockwise rotary movement of the frame structure 19.

The print device comprises a character-carrying disc or 'daisywheel' 41 of known type, for example of the type described in published European patent application EP 0 118 277, having a central hub 42 and a plurality of radial flexible spokes 43. The central hub 42 is fixed removably to a shaft 47 of a selector motor (not shown in the drawing). The end of each spoke 43 bears in raised form a print character 44 which is disposed on the side which is towards the platen roller 11 and, on the opposite side, a positioning wedge-shaped portion 46.

The print device as described hereinbefore is substantially the same as that described in published European patent application 0 122 039.

In accordance with the invention, the print device 10 (see FIG. 2) comprises a solenoid 51 and a striker hammer 52 which is capable of being actuated by the solenoid 51 to engage and guide a selected print character 44 towards the platen roller 11.

The solenoid 51 comprises a cylindrical casing 53 with a front core 54 and a rear core 56, all of ferromagnetic material, "front" and "rear" meaning towards the typist and towards the platen respectively. The solenoid further comprises an excitation coil 64, a movable armature 84, of ferromagnetic material and connected to the hammer 52 by way of a cylindrical stem 83, and a damping mechanism 70. The casing 53 is hollow in its interior and is fixed by means of screws 57 to a flange 58 which in turn is fixed by means of screws 59 to the plate 22.

The front core 54 and the rear core 56 having internal pole pieces 61 and 62 respectively, of a frustoconical configuration, and on the outside surface are in contact with a frame 63 of plastics material, on which the excitation coil 64 is wound in layers. The front core 54 further comprises a projection portion 66 having a seat 67 for removably accommodating a bush 68 of non-magnetic material, for example sintered bronze, which by means of an opening 89 guides a part of the stem 83 of the striker hammer 52, which projects forwardly from the armature 84. The portion 66 is closed at its front by a travel limiting stop or cover member 69 of ferromagnetic material having a hole in which one end 72 of the stem 83 is housed.

The bush 68, which weighs around 3 grams, constitutes a counteracting weight of the damping mechanism 70 and is provided with a rearward sleeve portion 73 of reduced diameter forming a flange 74 co-operable with a shoulder 76 on the front core 54 which forms an intermediate stop element for the bush 68.

The bush 68 has an internal seat or opening 77 for housing a counteracting coil spring 78 which is coaxial with the stem 83. The sprint 78 has a front end thereof bearing against the stop 69 and urges the bush 68 towards the rearward part, holding it in a position of abutment with the flange 74 against the shoulder 76. A damping disc 79 of plastics or rubber material is fixed on the front surface of the bush 68 and is co-operable with the stop 69, as will be described hereinafter.

Figure 3:
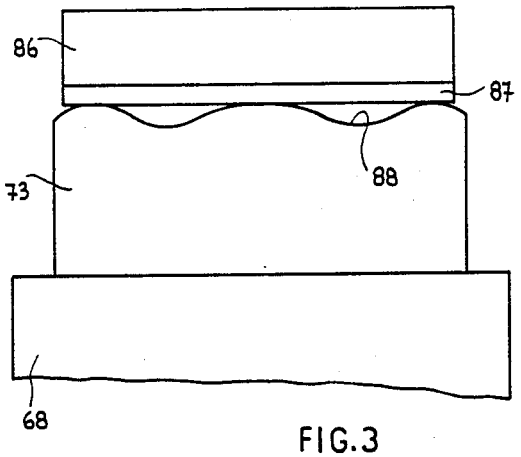
FIG. 3 is a view on an enlarged scale of some details from FIG. 2.

The striker hammer 52 of non-magnetic material and weighing around 5 grams comprises a rear end 91 of rectangular section integral with a cylindrical portion 81 which in turn is fixed to the cylindrical stem 83. Fitted on the portion 81 is a spring guide bush 82 of plastics material while disposed on the stem 83 is the magnetic armature 84. Mounted between the armature 84 and the bush 68 are a disc 86 of plastics or rubber material, adjacent the armature 84 and providing a damping function, and a thin disc 87 of plastics material, which is provided for avoiding the danger of the elastic disc 86 and the bush 68 sticking together. In order further to prevent sticking,, the bush 68 has a rear surface 88 (see FIG. 3) which is a corrugated configuration so that the disc 87 bears against the projecting convex wall portions which alternate with recessed concave wall portions which are connected together as shown in FIG. 3.

The striker hammer 52 (see FIG. 2) is guided movably by means of the stem 83, by the opening 89 in the bush 68, and, at the rear, by means of the end 91, by an opening 92 of rectangular section, in a fixed bush 93 of non-magnetic material which is fixed on the flange 58. The end 91 is shaped so as to provide a recess 94 of V-shaped section, capable of engaging with the corresponding positioning wedge-shaped portion 46 on each spoke 43 while the selected character 44 is caused to strike against the platen roller 11.

A spring guide bush 96 of plastics material is mounted within the rear core 56. The bushes 96 and 82 guide a coil return spring 97 of non-magnetic material. The spring 97 holds the striker hammer 52 spaced from the character-carrying disc 41, bearing against shoulders 98 and 99 of the bushes 82 and 96 and being guided axially by the bushes 82 and 96 which prevent radial vibration of the spring.

Figure 5:
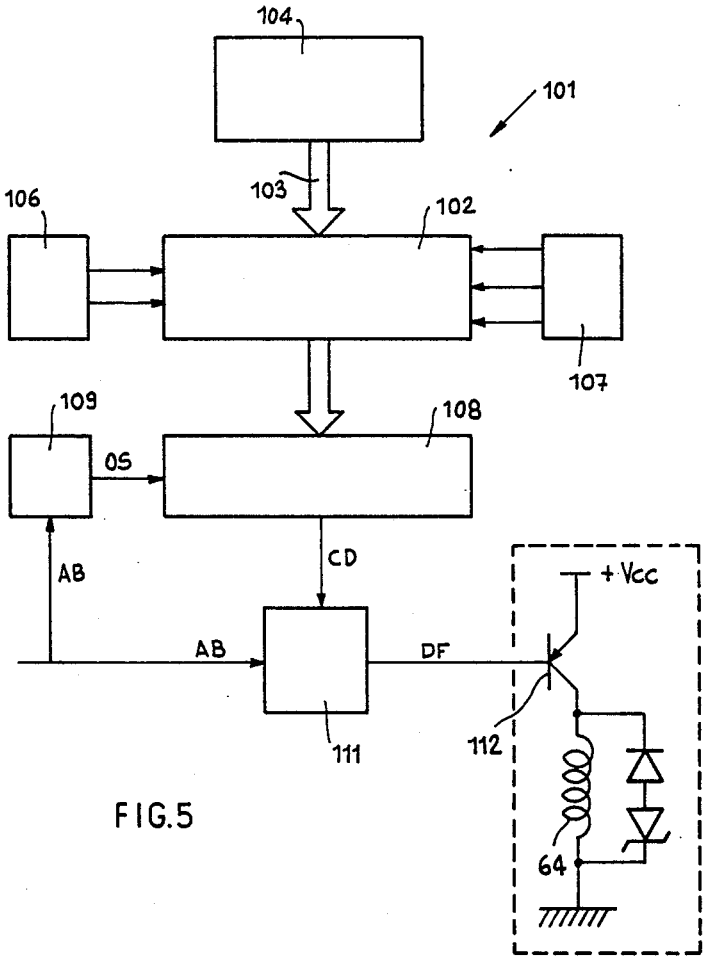
FIG. 5 shows a block circuit diagram of the circuit for actuating the device shown in FIG. 1.

The coil 64 of the solenoid 51 is excited with a current of substantially constant amplitude. By means of the desribed configuration, the kinetic energy of the hammer 52 is proportional to the time t for excitation of the coil 64. A control circuit 101 (see FIG. 5) varies the time t in dependence on the character to be printed, the printing strength and the characteristics of the striker device 10 generally, substantially as described in U.S. Pat. No. 4,308,794.

The characters, according to the size thereof, are subdivided into four groups which are stored in a ROM 102 and can be recalled by means of a bus 103 by an input device 104 which may be for example an electronic keyboard. Depending on the group to which the character to be printed belongs, the time t is automatically increased or reduced. In addition the overall strength of striking may be varied by means of selectors 106 and 107 of known type which are connected to the ROM 102.

The circuit 101 comprises a binary counter 108 which counts the pulses OS generated by an oscillator 109 and generates a pulse CD at the end of each counting operation. The signal CD resets a flip-flop 111 which has its set input connected to a signal AB for enabling printing. The signal AB is also applied to the oscillator 109 while the output signal DF of the flip-flop 111 is applied to the base of a transistor 112 of pnp type which has its emitter connected to one end of the coil 64 of the solenoid 51. The other end of the coil 64 is connected to earth. The collector of the transistor 112 is connected to a reference voltage +Vcc.

Figure 2:
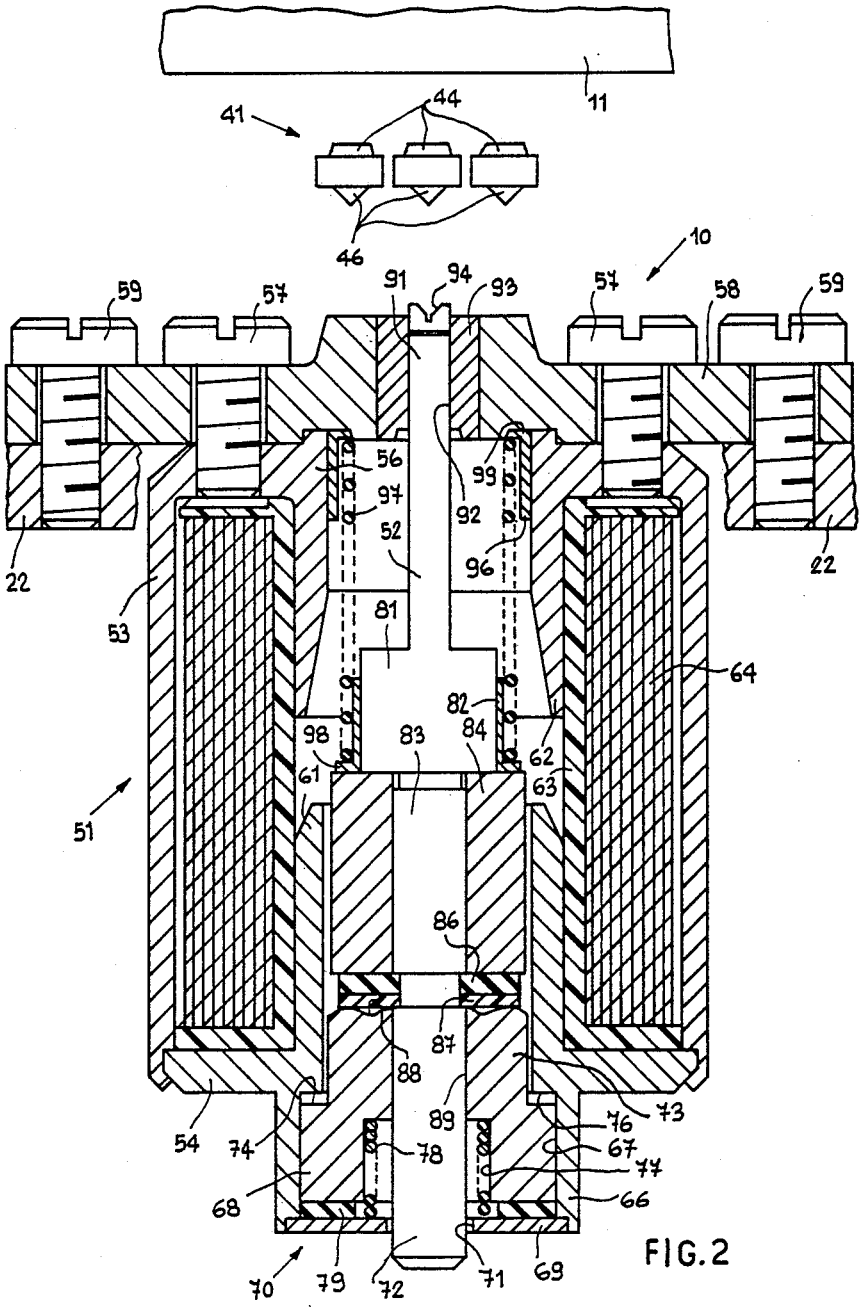
FIG. 2 is a partly sectional front view on an enlarged scale of the device shown in FIG. 1.
Figure 4:
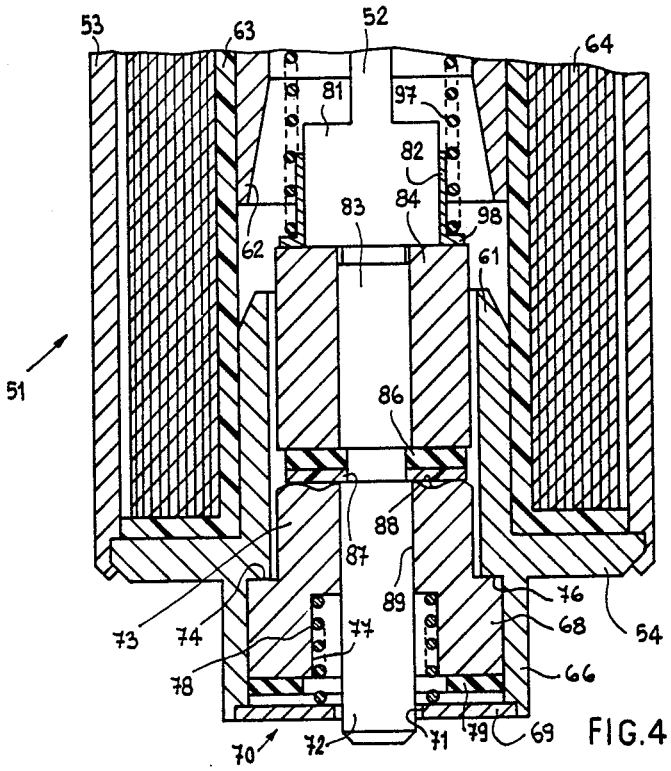
FIG. 4 is a front view of an alternative embodiment of the device shown in FIG. 2.

The print device 10 shown in FIG. 2 and the alternative embodiment shown in FIG. 4 differ only in regard to the loading of the springs 78 and 97.

In the device shown in FIG. 2, the load of the spring 78 is around 35 grams/mm while the load of the return spring 97 is around 65 grams/mm. In the rest condition, the hammer 52 is held spaced from the character-carrying disc 41 by the force of the return spring 97 which, producing a greater force than the spring 78, holds the hammer 52 with the armature 84, the disc 86 and the disc 87, in a condition of abutment against the corrugated surface 88 and the bush 68 with the disc 79 in a condition of abutment against the limit stop element 69.

To provide for striking of a print character 44, after the selected character 44 has been moved in any known manner in front of the strike hammer 52, the coil 64 is excited, thus producing a magnetic flux which causes the armature 84 to move towards the pole piece 62 against the force of the spring 97. The hammer 52 moves towards the platen roller 11 and, after having engaged the positioning wedge-like portion 46 of the selected character 44 by means of the V-shaped recess 94 in the hammer 52, causes the corresponding character to be struck against the platen roller 11, compensating for any misalignment of the character with respect to the point of printing 12.

As soon as the striker 52 begins its movement towards the platen roller 11, the spring 78 moves the bush 68 axially until it comes to bear with the flange 74 against the shoulder 76.

As has been set forth hereinbefore, the time t for excitation of the coil 64 is variable in dependence on the character selected by the keyboard and the strength of striking as selected by the selector 106. The group to which the selected character belongs causes the ROM 102 to generate a code which presets the counter 108. When the character-carrying disc 41 moves the selected character into the print position, the signal AB is generated which permits the oscillator 109 to generate the pulses OS and enables the flip-flop 111 for generation of the signal DF which causes excitation of the coil 64 to begin. After a certain time which is dependent on the preset time, the counter 108 generates the signal CD for the end of the counting operation, the flip-flop 111 is reset and excitation of the coil 64 is terminated.

After printing of the character, the return spring 97 (see FIG. 2) returns the hammer 52 and the armature 84 towards the rest position. During that travel, the armature 84 encounters the counteracting weight 68 which is temporarily in a stopped condition with the flange 74 bearing against the shoulder 76. The damping mechanism 70 comprising the weight 68, the spring 78 and the elements 86 and 79 damps the shock due to the rapid return movement of the hammer 52 and the armature 84 without appreciable oscillations and in successive phases. Firstly the elastic disc 86 strikes against the front surface 88 of the bush 68 and a first damping phase occurs, then the bush 68 also moves together with the hammer 52 and the armature 84 against the force of the spring 78 and a second damping phase occurs, and finally the elastic disc 79 strikes against the disc 69 and a third damping phase takes place, with total dissipation of the residual kinetic energy of the hammer 52 and the armature 84.

Under operating conditions, the hammer 52 completes its strike movement which is about 7.6 mm in about 5 msec and the return travel which is due to the force of the spring 97 in about 6 msec. The damping mechanism 70 damps the blow and the vibration due to the rapid return movement of the hammer 52 in about 2 msec and permits excitation of the coil 64 for fresh strike cycles about every 13 msec.

In the alternative embodiment shown in FIG. 4, the force of the counteracting spring 78 is around 105 grams/mm while that of the return spring 97 is around 65 grams/mm. In the rest condition, the striker hammer 52 is held spaced from the character-carrying disc 41 but the spring 97 is not capable of moving the bush 68 from its intermediate stop position. In particular, the hammer 52 with the armature 84, the disc 86 and the disc 87 remain in an abutting condition against the corrugated surface 88 of the bush 68. The bush 68 is in turn held in a stopped position by the force of the spring 78 with the flange 74 bearing against the shoulder 76.

The mode of operation of the embodiment shown in FIG. 4 is substantially identical with regard to the strike operation to that described above with the single exception of the absence of movement of the counteracting bush 68. The return movement of the hammer 52 to the rest position differs only in regard to the part thereof subsequent to the impact of the armature 84 against the weight 68. After striking of the selected character, the spring 97 returns the hammer 52 and the armature 84 to the rest position while the spring 78 holds the bush 68 in a stopped condition with the flange 74 bearing against the shoulder 76. In this case also, the elastic disc 86 strikes against the front surface 88 of the bush 68; the bush 68 then moves with the hammer 52 against the force of the spring 78 and finally the elastic disc 79 strikes against the stop element 69 in accordance with the three damping phases of the arrangement shown in FIG. 2. The difference in the arrangement shown in FIG. 4 is that the force of the spring 78 which is greater than that of the spring 97 provides that the spring 78, after impact with the bush 68, moves the bush 68 with the disc 86, the armature 84 and the hammer 52 towards the rearward part of the solenoid 51 until the bush 68 is again moved into a position of bearing with flange 74 against the shoulder 76.

In the embodiment shown in FIG. 4, the hammer 52 completes the strike travel in about 5 msec while the time for the return movement thereof, which is due to the force of the spring 97, is about 6 msec, and the damping mechanism 70 damps the vibration of the hammer 52 in about 6 msec. In this case therefore the coil 64 can be excited for fresh strike cycles every 17 msec approximately.

It will be apparent that the print device 10 as described hereinbefore has very short excitation times and reduced moving masses, by virtue of its structure; in addition the damping mechanism 70 shown in FIG. 2 or the mechanism shown in FIG. 4 associated therewith minimise the times required for the hammer 52 to settle down after the print operation.

As further alternative, the disc 86 could be fixed to the weight 73 and the disc 79 could be fixed to the stop disc 69. A mixing of different fixing of the damping discs is also possible without departing from the object of the invention.

What we claim is:

1. A print device for typewriter and like printing machines comprising a platen roller defining a point of printing; a character-carrying element having flexible spokes provided at the periphery with a series of characters which can be selectively positioned in front of the point of printing; a print hammer assembly movable frontwardly from a rest position to a printing position for moving a selected character against the platen roller; a solenoid including an actuating armature fixed to the print hammer assembly, a winding, a return coil spring for rapidly returning backwardly the print hammer assembly to the rest position after printing of each character, and an internal housing having an intermediate stop and a travel limit stop; and wherein said winding is energizable for moving frontwardly said armature against the action of said return coil spring; and damping means for reducing the time for damping of the print hammer assembly after printing of each character, wherein said damping means comprise:

a counteracting weight movable for a small amount in the same direction as the actuating armature between the intermediate stop and the travel limit stop, a first elastomeric member for damping purposes disposed between the actuating armature and the counteracting weight, a counteracting coil spring disposed between the counteracting weight and the travel limit stop and a second elastomeric member for damping purposes disposed between the counteracting weight and the travel limit stop, wherein the counteracting spring provides a force which is opposite and less than the force of the return spring in the rest position of the hammer assembly;

wherein the first elastomeric member is provided to be compressed at rest between said armature and said counteracting weight under the urging of the return spring on the print hammer assembly, while said counteracting weight is spaced apart a pre-set gap from said intermediate stop in the rest position of said print hammer and under the urging of said return coil spring;

wherein said second elastomeric member is provided to be compressed between said counteracting weight and said travel limit stop and to define the rest position of the print hammer under the urging of said return coil spring and less the action of said counteracting coil spring;

wherein said counteracting coil spring is provided to move frontwardly the counteracting weight through said pre-set gap upon a frontward movement of the print hammer, thereby releasing the second elastomeric member;

wherein said print hammer assembly is provided to strike against the counteracting weight through the first elastomeric stop for a rearward movement of said counteracting weight upon returning of the print hammer assembly to said rest position; and wherein said damping means are provided to produce a first damping phase by the first elastomeric member upon the striking of said print hammer assembly against the counteracting weight through the first elastomeric element, a second damping phase by the rearward movement of the counteracting weight through said pre-set gap and compression of said counteracting spring by the counterating weight and a third damping phase by the second elastomeric member compressed between the counteracting weight and the travel limit stop.

2. A print device for typewriters and like printing machines comprising a platen roller having a point of typing; a character-carrying element having radial flexible spokes, wherein each spoke bears a print character which can be selectively positioned in front of the point of typing; a print hammer which can be selectively actuated to move the selected print character against the platen roller, wherein said print hammer has a given weight; an actuating solenoid for actuating the print hammer including a casing having a front core, a rear core and a movable armature; a flange connected with the rear core and including a fixed bush having an opening disposed adjacent to the character-carrying element, wherein the front core comprises a projection portion having a seat; a travel limit element disposed opposite to the fixed bush with respect to the front core and rear core, to limit said seat frontwardly; a return coil spring for return to rest of the print hammer; a damping mechanism for damping the return to rest of the print hammer, wherein said damping mechanism includes an intermediate stop element to limit said seat rearwardly and a movable bush movably guided by said seat between the travel limit element and the intermediate stop element and comprising an opening; and means for defining the rest position of said print hammer;

wherein the print hammer comprises a rear end for cooperating with the spoke of the selected character, a cylindrical portion adjacent to said rear end and a cylindrical stem on which is fixed said armature, wherein said stem is disposed adjacent to said cylindrical portion, and comprises a groove and a front end, wherein said movable armature is positioned between said cylindrical portion and said groove and said return coil spring operates on said armature adjacent to said cylindrical portion, and wherein said print hammer is guided by the rear end housed in the opening of said fixed bush and by the front end housed in the opening of said movable bush and is held spaced from the platen roller in said rest position by means of said return coil spring;

wherein said solenoid is energizable for moving the movable armature toward said rear core, against the action of said return coil spring to actuate said print hammer;

wherein said damping mechanism further comprises a first damping element of resilient material engaged with said groove between the movable armature and the movable bush, a counteracting coil spring coaxial with the cylindrical stem and disposed between the movable bush and the travel limit element for biasing the movable bush toward the intermediate stop element and the platen roller and a second damping element of resilient material, coaxial with the cylindrical stem and disposed between the movable bush and the travel limit element wherein said means for defining the rest position include the movable bush, the first damping element which bears on said movable bush and one of said intermediate stop member and travel limit element and wherein said counteracting coil spring urges the movable bush to be arrested against the intermediate stop element upon actuation of the print hammer toward the print position; and wherein said damping mechanism is provided for producing sequential damping functions, including a first damping phase effected by said first damping element as compressed by the action of the movable armature and the movable bush, transmission of movement from the armature to the movable bush in order to move the movable bush from the arrest against said intermediate stop element to the travel limit element, compression of said counteracting coil spring and a following damping phase effected by the second damping element as compressed between the movable bush and said travel limit element at said rest position under the action of said rest position defining means, thereby minimizing the time for the print hammer to settle down at said rest position.

3. A print device according to claim 2, wherein the movable bush comprises a front seat coaxial to said opening and having a bottom and wherein the counteracting coil spring is housed and guided by said front seat and is compressed between said bottom and the travel limit element.

4. A print device according to claim 3, wherein the second damping element comprises an elastomeric disc coaxial with the counteracting spring.

5. A print device according to claim 2, wherein the first damping element comprises a disc of elastomer material, and further comprising a thin disc of plastic material, also engaged with said groove adjacent to said disc of elastomeric material, wherein the movable bush has a rear surface, opposite to the front seat, which has a corrugated configuration having projecting convex walls and recessed concave walls so that the thin disc of plastic material bears against the projecting convex walls such as to minimize sticking of the thin disc of plastic material on said corrugated rear surface.

6. A print device according to claim 5, wherein the rest position defining means include said travel limit element and wherein the return coil spring provides a greater force than that of the counteracting coil spring, such that said movable bush is spaced apart from said intermediate stop element in the rest position of said print hammer;

wherein in the rest position of the print hammer the return spring compresses the disc of resilient material, holds into contact the thin disc with said corrugated surface, and holds the movable bush and the second damping element compressed between the travel limit element and said compressed counteracting spring, and wherein in the actuated position of the spring hammer, the counteracting spring moves the movable bush to be arrested against the intermediate stop element, and after the print of the selected character, the return coil spring moves the print hammer with the armature toward the rest position, the disc of elastomeric material is compressed between the armature and the thin disc, and the thin disc strikes against the corrugated rear surface of the movable bush for the first damping phase, subsequently continues its travel with the movable bush and compresses the counteracting spring, and stops with the second damping element against he travel limit element for the following damping phase.

7. A print device according to claim 5, wherein the rest position defining means include said intermediate stop element and wherein the return coil spring provides a force which is less than that of said counteracting coil spring, such that said movable bush is spaced apart from said travel limit element in the rest position of said print hammer;

wherein in the rest position of the print hammer the return coil spring compresses the disc of resilient material, holds into contact the thin disc with said corrugated surface, while the counteracting coil spring holds the movable bush arrested against said intermediate stop element, and the movable bush is far from said second damping element, and, after the print of the selected character, the return coil spring moves the print hammer with the armature toward the rest position, the disc of elastomeric material is compressed between the armature and the thin disc, and the thin disc strikes against the corrugated rear surface of the movable bush for the first damping phase, subsequently continues its travel with the movable bush and compresses the counteracting coil spring, and stops with the second damping element against the travel limit element for the following damping phase, and wherein the counteracting coil spring then moves the movable bush back against the intermediate stop element at the end of the third damping phase and against the action of said return spring.

8. A print device for printing machines comprising a platen roller having a point of typing; a character-carrying element having radial flexible spokes provided at the periphery with a series of characters which can be selectively positioned in front of the point of typing; a print hamber which can be actuated from a rest position to a printing position for moving a selected character against the platen roller; and a solenoid for actuating the print hammer comprising a magnetic armature, a winding and an internal housing having a travel limit element disposed opposite to the character-carrying element, and an intermediate stop element disposed opposite to the character-carrying element, a return coil spring for returning the spring hammer to the rest position after printing of the selected character, a damping mechanism for damping the return to rest position of the print hammer, and means for defining the rest position of said print hammer;

wherein the print hammer comprises a rear end for cooperating with a spoke of the selected character, and a stem on which is fixed the magnetic armature;

wherein the print hammer provides an intermediate surface and the damping mechanism comprises a series of damping elements which produce sequential damping functions, minimizing the time for the print hammer to settle down, said series comprising a movable bush operating a as a counteracting weight for the print hammer, housed in said internal housing, accommodating a front portion of said stem and movable between the travel limit element and the intermediate stop element, a first damping element disposed between said intermediate surface and said movable bush, a counteracting coil spring disposed between the movable bush and the travel limit element, and a second damping element disposed between the movable bush and the travel limit element;

wherein said winding is energizable for moving said armature against the action of said return coil spring to actuate the print hammer, wherein said means for defining the rest position comprise said movable bush and said first damping element sandwiched between said intermediate surface and said movable bush and one of said intermediate stop element and said travel limit element;

wherein in the rest position of the print hammer the return coil spring urges the intermediate surface toward the movable bush to compress said first damping element and the counteracting coil spring urges the movable bush toward said intermediate stop;

wherein said counteracting coil spring is provided to cause said movable bush to be arrested against said intermediate stop element, upon the actuation of said print hammer; and wherein said sequential damping functions comprise a first damping phase by said first damping element as compressed by the action of said intermediate surface against the movable bush, transmission of movement from said intermediate surface to the movable bush, compression of said counteracting coil spring, and a following damping phase effected by said second damping element as compressed between the movable bush and said travel limit element.

9. A print device according to claim 8, wherein the first and the second damping elements each comprises an elastomeric disc of damping material, wherein the movable bush comprises an internal seat having a bottom, wherein the spring element comprises a counteracting coil spring housed in the internal seat and disposed between a bottom of said seat and the travel limit element, and wherein said second damping element provides a hole accommodating said coil spring and said stem.

10. A print device according to claim 8, wherein the seat of the movable bush the stem of the print hammer to its printing position and its rest position.

11. A print device according to claim 8, wherein the rest position defining means include said travel limit element and wherein the return coil spring provides a force which is greater than that of the counteracting coil spring, such that said movable bush is spaced apart from said intermediate stop element in the rest position of said print hammer;

wherein in the rest position of the print hammer the return spring compresses the first damping element, and holds the movable bush and the second damping element compressed between the travel limit element and said compressed counteracting spring; and wherein in the actuated position of the print hammer, the counteracting spring moves the movable bush to be arrested against the intermediate stop element after the print of the selected character, the return coil spring moves the print hammer with the armature toward the rest position, the first damping means is compressed between the intermediate surface and the movable bush for the first damping phase, subsequently continues it travel with the movable bush and compresses the counteracting spring, and stops with the second damping element against the travel limit element for the following damping phase.

12. A print device according to claim 8, wherein the rest position defining means include said intermediate stop element and wherein the return coil spring provides a force which is less that that of said counteracting coil spring, such that said movable bush is spaced apart from said limit element in the rest position of said print hammer;

wherein in the rest position of the print hammer the return coil spring compresses said first damping means, while the counteracting coil spring holds the movable bush arrested against said intermediate stop element and the movable bush is spaced apart from said second damping element, and, after the print of the selected character, the return coil spring moves the print hammer with the armature toward the rest position, said first damping means is compressed between said intermediate surface and the movable bush for the first damping phase, subsequently continues its travel with the movable bush and compresses the counteracting coil spring, and stops with the second damping element against the travel limit element for the following damping phase, and wherein the counteracting coil spring then moves the movable bush back against the intermediate stop element at the end of the third damping phase and against the action of said return spring.

13. A print device for typewriter and like printing machines comprising a platen roller defining a point of printing; a character-carrying element having flexible spokes provided at the periphery with a series of characters which can be selectively positioned in front of the point of printing; a print hammer movable rearwardly along a printing direction from a rest position to a printing position for moving a selected character against the platen roller, whenin said print hammer comprises a stem, having an intermediate portion, a front portion and a rear portion; a solenoid including an actuating armature fixed to the intermediate portion of said stem, a return coil spring for rapidly returning the print hammer to the rest position after printing of each character, and a casing comprising a rear core having rear guide means for guiding the rear portion of said stem and a front core including an internal housing having an intermediate stop and a travel limit stop; damping means for reducing the time for damping of the print hammer after printing of each character; and means for defining the rest position of said stem, wherein said damping means are housed into the internal housing and comprise:

a counteracting weight movable for a pre-set gap of small amount along said printing direction between the intermediate stop and the travel limit stop, wherein said internal housing comprises front guide means for guiding said counteracting weight along said printing direction, wherein said counteracting weight comprises guide means for guiding the front portion of said stem between the rest position and the printing position of said print hammer, a first damping element having an elastomeric disc for damping purposes disposed between the actuating armature and the counteracting weight, a counteracting coil spring disposed between the counteracting weight and the travel limit element and a second damping element having an elastomeric disc for damping purposes disposed between the counteracting weight and the travel limit element, wherein said means for defining the rest position comprise said counteracting weight, said actuating armature, said first damping element and one of said intermediate stop and said travel limit stop;

wherein said counteracting coil spring is provided to urge frontwardly the counteracting weight in order to ensure arrest of said counteracting weight against said intermediate stop upon actuation of said print hammer;

wherein said actuating armature is provided to strike against the counteracting weight through the first damping element for a rearward movement of said counteracting weight upon returning of the print hammer to said rest position; and wherein said damping means are provided to produce a first damping phase by the first damping element upon the striking of said armature against the counteracting weight through the first elastomeric element, a second damping phase by the rearward movement of the counteracting weight through said pre-set gap and compression of said counteracting spring by the counteracting weight and a third damping phase by the second damping element compressed between the counteracting weight and the travel limit stop up to arrest of said print hammer by said means for defining the rest position of said stem.

14. A print device according to claim 13, wherein said internal housing houses the actuating armature and the return coil spring coaxially with the print hammer, and the guide means of the rear core comprise a seat for guiding the rear portion of said stem during the movements of the print hammer from the rest position to the printing position and vice versa, and wherein the counteracting coil spring is coaxial with the front portion of said stem and a hole of said second damping element.

15. A device according to claim 14, wherein the counteracting spring provides a greater force than the force of the return spring and normally holds the counteracting weight in a stopped condition against the intermediate stop counteract the action of the return spring.

* * * * *